US007687994B2

(12) United States Patent
Jung et al.

(10) Patent No.: US 7,687,994 B2
(45) Date of Patent: Mar. 30, 2010

(54) PLASMA DISPLAY PANEL (PDP)

(75) Inventors: Eun-Young Jung, Suwon-si (KR); Jeong-Chull Ahn, Suwon-si (KR)

(73) Assignee: Samsung SDI Co., Ltd., Yeongtong-gu, Suwon-si, Gyeonggi-do (KR)

( * ) Notice: Subject to any disclaimer, the term of this patent is extended or adjusted under 35 U.S.C. 154(b) by 290 days.

(21) Appl. No.: 11/589,053

(22) Filed: Oct. 30, 2006

(65) Prior Publication Data

US 2007/0257613 A1 Nov. 8, 2007

(30) Foreign Application Priority Data

May 4, 2006 (KR) ..... 10-2006-0040400

(51) Int. Cl.
*H01J 17/49* (2006.01)

(52) U.S. Cl. ..... 313/582; 313/583; 313/584; 313/585

(58) Field of Classification Search ..... 313/582–587; 315/169.3, 169.4; 345/60, 30, 37; 445/24, 445/25

See application file for complete search history.

(56) References Cited

U.S. PATENT DOCUMENTS

| | | | | |
|---|---|---|---|---|
| 2002/0047566 | A1* | 4/2002 | Kim et al. | 315/169.3 |
| 2002/0089292 | A1* | 7/2002 | Ahn | 315/169.3 |
| 2003/0168977 | A1* | 9/2003 | Hashikawa | 313/582 |
| 2004/0169621 | A9* | 9/2004 | Lee et al. | 345/60 |
| 2006/0082303 | A1* | 4/2006 | Song | 313/582 |
| 2007/0001601 | A1* | 1/2007 | Nishitani et al. | 313/582 |
| 2007/0285013 | A1* | 12/2007 | Amano | 313/584 |

FOREIGN PATENT DOCUMENTS

| | | | |
|---|---|---|---|
| JP | 2004-253334 | A | 9/2004 |
| KR | 2001-0019211 | A | 3/2001 |
| KR | 2005-0052203 | A | 6/2005 |

OTHER PUBLICATIONS

"Korean Office Action" issued on Mar. 30, 2009 in Applicant's corresponding Korean Patent Application No. 2006-0040400.

* cited by examiner

*Primary Examiner*—Bumsuk Won
*Assistant Examiner*—Elmito Breval
(74) *Attorney, Agent, or Firm*—Robert E. Bushnell, Esq.

(57) ABSTRACT

A Plasma Display Panel (PDP) capable of reducing an address discharge voltage between address electrodes and Y electrodes, suppressing an address discharge delay, and improving brightness includes: a first substrate, a second substrate spaced apart from the first substrate and facing the first substrate, barrier ribs arranged between the first and second substrates and defining discharge cells where a discharge occurs, discharge electrode pairs including X electrodes and Y electrodes extending across the discharge cells, floating electrodes arranged closer to the Y electrodes than to the X electrodes, address electrodes extending across the discharge cells and intersecting the discharge electrode pairs within the discharge cells, and phosphor layers arranged within the discharge cells. Portions of the address electrodes facing the Y electrodes are wider than portions of the address electrodes facing the X electrodes, or distances between the Y electrodes and the portions of the address electrodes facing the Y electrodes are shorter than distances between the X electrodes and the portions of the address electrodes facing the X electrodes.

20 Claims, 6 Drawing Sheets

PLASMA DISPLAY PANEL (PDP)

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 4 May 2006 and there duly assigned Serial No. 10-2006-0040400.

BACKGROUND OF THE INVENTION

1. Field of the Invention

The present invention relates to a Plasma Display Panel (PDP), and more particularly, to a PDP in which a discharge is easily initiated and in which a discharge delay is reduced.

2. Description of the Related Art

Plasma Display Panels (PDPs) are display devices which display images by exciting phosphors with ultraviolet (UV) rays generated during a gas discharge. PDPs have attracted considerable attention as a next-generation thin display device that can be easily manufactured in a large size and display high-resolution images.

Such PDPs are classified into Direct Current (DC), Alternating Current (AC) PDPs, and hybrid according to the structures thereof and the driving principles thereof. AC and DC PDPs can also be classified into facing discharge PDPs and surface discharge PDPs according to the type of discharge structure. In recent years, AC surface discharge PDPs have been generally used.

An AC PDP includes an upper plate displaying an image to users and a lower plate coupled to the upper plate, the lower plate and the upper plate being parallel to each other. Sustain electrode pairs, each having an X electrode and a Y electrode, are arranged on a front substrate of the upper plate. Address electrodes are arranged on a rear substrate of the lower plate that faces the front substrate on which the sustain electrode pairs are arranged, and intersect the electrodes on the front substrate. A first dielectric layer and a second dielectric layer are respectively formed on the front substrate, including the sustain electrode pairs, and the rear substrate, including the address electrodes, to bury the electrodes. A protection layer, which is typically formed of MgO, is arranged on the rear surface of the first dielectric layer. Barrier ribs, securing a discharge distance and preventing electrical and optical cross-talk between discharge cells, are arranged on the front surface of the second dielectric layer. Red, green, and blue phosphor materials are coated on both sidewalls of the barrier ribs and portions of the front surface of the second dielectric layer that are not occupied by the barrier ribs. The X electrode and the Y electrode respectively include transparent electrodes and respectively include bus electrodes. A space defined by an X electrode, a Y electrode, and an address electrode intersecting the X and Y electrodes is referred to as a unit discharge cell, which forms a single discharge portion.

To obtain a high-resolution image, discharge cells become smaller and smaller. This results in an increase in driving voltage and a decrease in the luminous efficiency. When Xe of 10% or more is used to solve these problems, a discharge voltage increases accordingly. Thus, this resolution fails to achieve stable driving.

SUMMARY OF THE INVENTION

The present invention provides a Plasma Display Panel (PDP) capable of reducing an address discharge voltage between address electrodes and Y electrodes, suppressing address discharge delay, and improving brightness.

According to one aspect of the present invention, a Plasma Display Panel (PDP) is provided including: a first substrate; a second substrate spaced apart from the first substrate and facing the first substrate; barrier ribs arranged between the first and second substrates and defining discharge cells where a discharge occurs; discharge electrode pairs comprising X electrodes and Y electrodes extending across the discharge cells; floating electrodes arranged closer to the Y electrodes than to the X electrodes; address electrodes extending across the discharge cells and intersecting the discharge electrode pairs within the discharge cells, portions of the address electrodes facing the Y electrodes being wider than portions of the address electrodes facing the X electrodes; and phosphor layers arranged within the discharge cells.

The discharge electrode pairs preferably include metallic conductors. The discharge electrode pairs preferably include transparent electrodes, and bus electrodes of a metallic conductor.

The floating electrodes preferably include metallic conductors. The floating electrodes preferably include transparent electrodes. Each of the floating electrodes are preferably electrically separated to prevent electrical signals from being received by the floating electrodes.

A voltage is preferably induced in each of the floating electrodes in response to a voltage being supplied to the Y electrodes.

The floating electrodes are preferably electrically separated and arranged to correspond to the discharge cells one to one. The floating electrodes are preferably arranged between the X electrodes and the address electrodes.

The X electrodes and the Y electrodes preferably extend parallel to one another.

The PDP preferably further includes: a first dielectric layer covering the discharge electrode pairs and the floating electrodes; and a second dielectric layer covering the address electrodes.

The discharge electrode pairs are preferably arranged on the first substrate opposite to the second substrate and covered by the first dielectric layer; the address electrode pairs are preferably arranged on the second substrate opposite to the first substrate and covered by the second dielectric layer; and the barrier ribs are preferably arranged between the first and second dielectric layers.

The PDP preferably further includes a protection film arranged to cover at least a portion of the first dielectric layer. The PDP preferably further includes a discharge gas contained within the discharge cells. The discharge gas preferably includes Xe of no less than 10% volume.

According to another aspect of the present invention, a Plasma Display Panel (PDP) is provided including: a first substrate; a second substrate spaced apart from the first substrate and facing the first substrate; barrier ribs arranged between the first and second substrates and defining discharge cells where a discharge occurs; discharge electrode pairs comprising X electrodes and Y electrodes extending across the discharge cells; floating electrodes arranged closer to the Y electrodes than to the X electrodes; address electrodes extending across the discharge cells and intersecting the discharge electrode pairs within the discharge cells, distances between the Y electrodes and portions of the address electrodes facing the Y electrodes being shorter than distances between the X electrodes and portions of the address electrodes facing the X electrodes; and phosphor layers arranged within the discharge cells.

Each of the floating electrodes are preferably electrically separated to prevent electrical signals from being received by the floating electrodes.

The portions of the address electrodes facing the Y electrodes preferably protrude from the address electrodes.

The PDP preferably further includes: a first dielectric layer covering the discharge electrode pairs and the floating electrodes; and a second dielectric layer covering the address electrodes.

The PDP preferably further includes: a discharge gas contained within the discharge cells, the discharge gas including Xe of no less than 10% volume.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
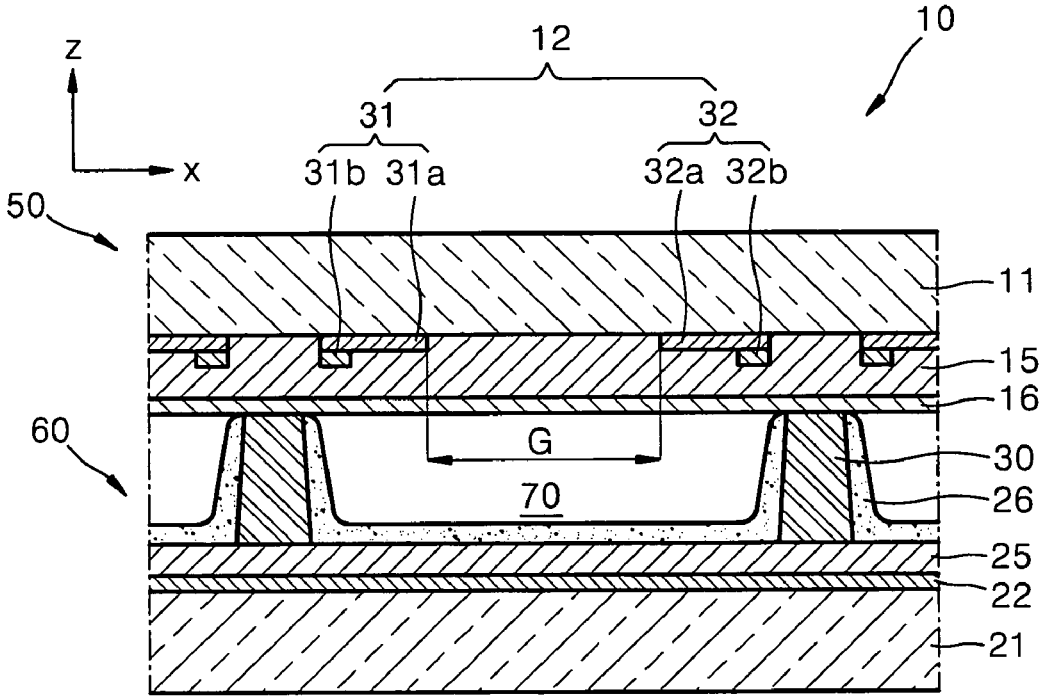
FIG. 1 is a vertical cross-section of a Plasma Display Panel (PDP)

As illustrated in FIG. 1, a AC PDP 10 includes an upper plate 50 displaying an image to users and a lower plate 60 coupled to the upper plate 50, the lower plate 60 and the upper plate 50 being parallel to each other. Sustain electrode pairs 12, each having an X electrode 31 and a Y electrode 32, are arranged on a front substrate 11 of the upper plate 50. Address electrodes 22 are arranged on a rear substrate 21 of the lower plate 60 that faces the front substrate 11 on which the sustain electrode pairs 12 are arranged, and intersect the electrodes 31 and 32 on the front substrate 11. A first dielectric layer 15 and a second dielectric layer 25 are respectively formed on the front substrate 11, including the sustain electrode pairs 12, and the rear substrate 21, including the address electrodes 22, to bury the electrodes 12 and 22. A protection layer 16, which is typically formed of MgO, is arranged on the rear surface of the first dielectric layer 15. Barrier ribs 30, securing a discharge distance and preventing electrical and optical cross-talk between discharge cells, are arranged on the front surface of the second dielectric layer 25. Red, green, and blue phosphor materials 26 are coated on both sidewalls of the barrier ribs 30 and portions of the front surface of the second dielectric layer 25 that are not occupied by the barrier ribs 30. The X electrode 31 and the Y electrode 32 respectively include transparent electrodes 31*a* and 32*a* and respectively include bus electrodes 31*b* and 32*b*. A space defined by an X electrode 31, a Y electrode 32, and an address electrode 22 intersecting the X and Y electrodes is referred to as a unit discharge cell 70, which forms a single discharge portion.

The present invention is described more fully below with reference to the accompanying drawings, in which exemplary embodiments of the invention are shown.

Figure 2:
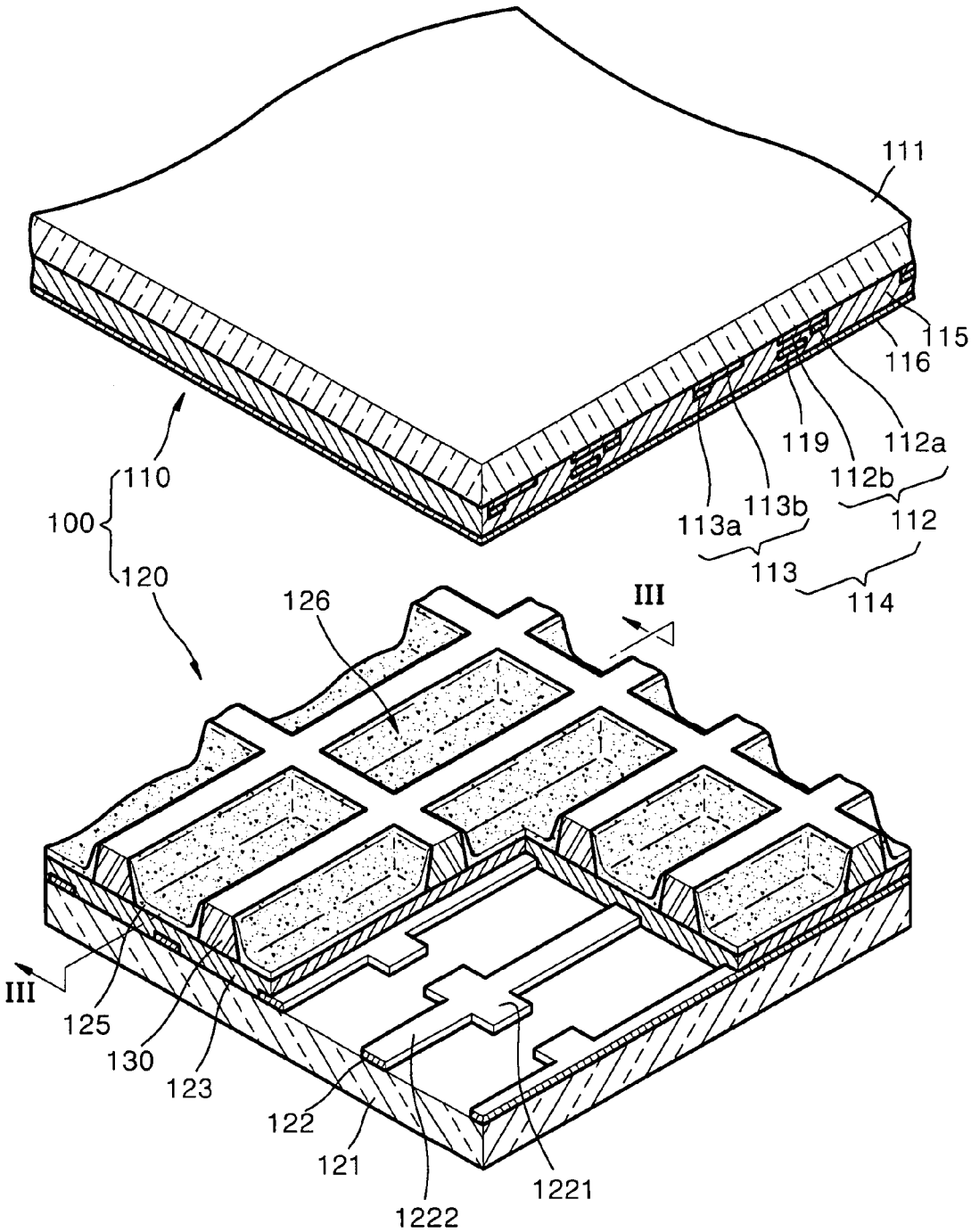
FIG. 2 is an exploded perspective view of a PDP according to an embodiment of the present invention.
Figure 3:
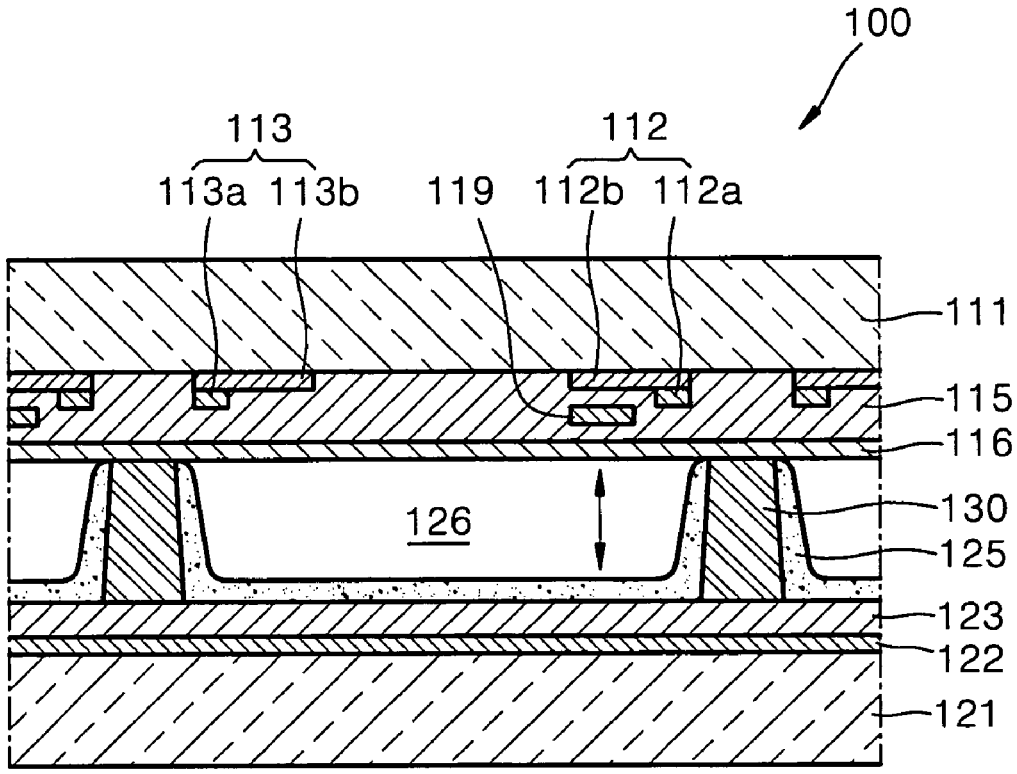
FIG. 3 is a cross-section taken along line III-III of FIG. 2.

FIG. 2 is an exploded perspective view of a Plasma Display Panel (PDP) 100 according to an embodiment of the present invention. FIG. 3 is a cross-section taken along line III-III of FIG. 2.

Referring to FIGS. 2 and 3, the PDP 100 includes a first panel 110 and a second panel 120.

The first panel 110 includes a first substrate 111, discharge electrode pairs 114 each having an X electrode 113 and a Y electrode 112 that extend across the discharge cells 126 and are arranged on the first substrate 111, floating electrodes 119 arranged closer to the Y electrodes 112 than to the X electrodes 113, a first dielectric layer 115 covering the X electrodes 113, the Y electrodes 112, and the floating electrodes 119, and a protection film 116 arranged on the first dielectric layer 115.

The second panel 120 includes a second substrate 121 spaced apart from the first substrate 111 and facing the first substrate 111, address electrodes 122 intersecting the discharge electrode pairs 114 within the discharge cells 126 and each having portions 1222 facing the X electrodes 113 and portions 1221 facing the Y electrodes 112 and being wider than the portions 1222, and a second dielectric layer 123 arranged on the second substrate 121 and covering the address electrodes 122.

Barrier ribs 130, defining the discharge cells 126 where a discharge occurs, are arranged between the first and second substrates 111 and 121. Phosphor layers 125 and a discharge-gas are contained within the discharge cells 126.

The first and second panels 110 and 120 are supported by the barrier ribs 130 and sealed together with a material, such as, frit, arranged on the edges of the first and second panels 111 and 120.

The first substrate 111 can be formed of a transparent material having a predetermined strength, such as soda glass or transparent plastic.

The discharge electrode pairs 114 are arranged on the first substrate 111 through which visible light generated in the discharge cells 126 passes. The X and Y electrodes 113 and 112, constituting the discharge electrode pairs 114, respectively include transparent electrodes 113*b* and 112*b*, formed of a transparent material, such as Indium Tin Oxide (ITO). The X and Y electrodes 113 and 112 can extend parallel to each other. The transparent electrodes 113*b* and 112*b* have a disadvantage of low electrical conductivity. To address this disadvantage, the X and Y electrodes 113 and 112 can respectively further include bus electrodes 113*a* and 112*a*, formed of a material having a high electrical conductivity, such as Au, Cu, or Cr, and respectively arranged on the X and Y electrodes 113 and 112 in the length direction thereof. The bus electrodes 113*a* and 112*a* preferably have smaller widths than the X and Y electrodes 113 and 112 so as to increase visible light transmissivity.

The floating electrodes 119 are arranged closer to the Y electrodes 112 than to the X electrodes 113. In particular, the floating electrodes 119 are arranged between the Y electrodes 112 and the address electrodes 122. The floating electrodes 119 are formed of an electrically conductive material, such as a metal. The floating electrodes 119 are formed of a transparent material, such as ITO, so as to easily transmit visible light. Functions of the floating electrodes 119 will be described later in conjunction with the driving of the PDP 100.

The discharge electrode pairs 114 and the floating electrodes 119 can be formed by coating an electrode paste on the entire surface of the first substrate 111 using a screen printing method or the like and drying and baking the electrode paste. Alternatively, the discharge electrode pairs 114 and the floating electrodes 119 can be formed using a photolithography method in which an electrode paste including a photosensitive photoresist is etched using photosensitive equipment.

The first dielectric layer 115 induces wall charges for a discharge within the discharge cells 126 by inducing charged particles using a potential supplied to the discharge electrode pairs 114. The first dielectric layer 115 also protects the discharge electrode pairs 114.

The first dielectric layer 115 can be formed by coating a dielectric paste including PbO, $SiO_2$, or the like on the first substrate 111 using a screen printing method and baking the dielectric paste.

The protection film 116 can be formed by depositing a material including MgO or the like on the first dielectric layer 115. The protection film 116 increases the emission of secondary electrons during a discharge to facilitate the discharge, and protects the first dielectric layer 115 and the discharge electrode pairs 114 from charged particles accelerated during the discharge.

The second substrate 121 can be formed of soda glass or the like, like the first substrate 111. However, since the second substrate 121 is not placed on a light path in which the visible light generated by the discharge cells 126 travels, the second substrate 121 does not need to be formed of a transparent material. In other words, the second substrate 121 can be formed of the other materials, such as plastic or metal, so as to reduce the amount of unnecessary power or the weight of the PDP 100.

The portions 1221 of the address electrodes 122, facing the Y electrodes 112, are wider than the portions 1222 thereof, facing the X electrodes 113. Since the address electrodes 122 are not placed on the path of the visible light unlike the discharge electrode pairs 114, they do not need to be formed of a transparent material, such as ITO. The address electrodes 122 can be formed of a material having high electrical conductivity, such as Ag, Cu, or Cr. Functions of the address electrodes 122 depending on their shapes will be described later in conjunction with the driving of the PDP 100.

The second dielectric layer 123, covering the address electrodes 122, is optional. For example, if the phosphor layers 125 are arranged on the address electrodes 122 and cover them, the phosphor layers 125 can serve as a dielectric layer. Thus, in this case, the second dielectric layer 123 is not needed.

However, particularly when the barrier ribs 130 are formed using a sandblasting process, the installation of the second dielectric layer 123 to cover the address electrodes 122 is preferable in order to prevent the address electrodes 122 from being damaged and to facilitate an address discharge.

The barrier ribs 130 can be formed of a glass component including atoms, such as Pb, B, Si, Al, or O. In some cases, the glass component can include a filler, such as $ZrO_2$, $TiO_2$, or $Al_2O_3$, and a pigment, such as Cr, Cu, Co, Fe, or $TiO_2$.

The barrier ribs 130 can be formed by coating a paste of a barrier rib material and patterning the paste using a sandblasting process, a photolithography method, or an etching method.

Although rectangular discharge cells 126 defined by the barrier ribs 130 are illustrated, the shapes of the discharge cells 126 are not limited to a rectangle but can be the other various shapes, such as, a polygon, a circle, a honeycomb, etc.

Each line of discharge cells 126 can have a strip-shaped horizontal cross-section, instead of having closed horizontal cross-sections. However, when the discharge cells 126 have closed horizontal cross-sections, the discharge electrode pairs 114 are located over the barrier ribs 130 so as to enclose the discharge cells 126. Thus, a cubic discharge is generated, and accordingly, the amount of discharge is increased.

The phosphor layers 125 can include classified into red phosphor layers, green phosphor layers, and blue phosphor layers so that the PDP 100 displays a color image. The red phosphor layers, the green phosphor layers, and the blue phosphor layers are arranged within the discharge cells 126 and combined so as to form unit pixels that realize a color image.

The phosphor layers 125 can be arranged by deposing a phosphor paste obtained by mixing one of a red phosphor, a green phosphor, and a blue phosphor in a space defined by the barrier ribs 130 and the second substrate 121 and then drying and baking the phosphor paste.

The red phosphor can be $(Y,Gd)BO_3:Eu^{3+}$, the green phosphor can be $Zn_2SiO_4:Mn^{2+}$, and the blue phosphor can be $BaMgAl_{10}O_{17}:Eu^{2+}$.

The discharge cells 126 in which the red phosphor layers 125 are arranged, the discharge cells 126 in which the green phosphor layers 125 are arranged, and the discharge cells 126 in which the blue phosphor layers 125 are arranged are arrayed adjacent to one another so as to constitute unit pixels which are basic units in which an image is displayed. However, the configuration of the discharge cells 126 does not need to be limited to the above-described configuration in one direction in order to achieve a color image. In some cases, the discharge cells 126 in which the red phosphor layers 125 are arranged, the discharge cells 126 in which the green phosphor layers 125 are arranged, and the discharge cells 126 in which the blue phosphor layers 125 are arranged can have different widths and lengths depending on the efficiency of a phosphor material and can have other various configurations, such as, a lattice, a delta, etc.

The phosphor layers 125 do not need to be located within the spaces defined by the second substrate 121 and the barrier ribs 130 as illustrated in FIG. 2. In other words, the phosphor layers 125 can be arranged in spaces defined by the barrier ribs 130 and the first substrate 111 or the other spaces.

A discharge gas contained within the discharge cells 126 can be helium (He), argon (Ar), neon (Ne) that includes zenon (Xe) gas, or a mixture of at least two of these gases. To obtain an image with a high brightness, the discharge gas preferably includes Xe with a volume of 10% or greater.

Since the discharge gas is generally charged with a pressure lower than atmospheric pressure, the first and second panels 110 and 120 are compressed by vacuum pressure. However, the barrier ribs 130 support the first and second panels 110 and 120.

A driving of the PDP 100, functions of the floating electrodes 119, and different functions of the address electrodes 122 depending on the shapes thereof are described below with reference to FIG. 3.

The PDP 100 according to the embodiment illustrated in FIGS. 2 and 3 can be driven according to various driving methods, such as an ADS driving method, an ALIS driving method, an AWD driving method, etc. Although several factors of the PDP 100, such as an image quality, response speed, etc., can vary according to the type of driving method, the driving method does not change the essential features of the present invention. Hence, how the PDP 100 is driven according to the ADS driving method is described below.

In general, a discharge is generated within each of the discharge cells of a PDP in order to achieve an image display, etc. Accordingly, the amount of wall charges or the number of charged particles is different between discharge cells. Hence, when discharges generated in the discharge cells need to be uniformly controlled, the uniform control of discharges between discharge cells is difficult.

To prevent this problem, a high voltage exceeding a certain level is supplied to all of the discharge cells 126 so that discharges are generated in all of the discharge cells 126 at the same time. Hence, wall charges pre-existing within the discharge cells 126 are removed and equalized, and the numbers of charged particles within the discharge cells 126 become equal. This process is referred to as a reset discharge.

Mores specifically, such a reset discharge is generally performed by supplying a high potential, that is, a lamp potential, to all of the Y electrodes 112, supplying a ground potential to all of the address electrodes 122, and supplying a bias potential to the X electrodes 113 for a predetermined period of time to thereby generate discharges within all of the discharge cells 126.

After the reset discharge, an address discharge is generated. In the address discharge, discharge cells 126 in which one electrode among the discharge electrode pairs 114, for example, Y electrodes 112, and the intersecting address electrodes 122 are selected as discharge cells 126 that are to produce images according to an external image signal. To generate a discharge in the selected discharge cells 126, predetermined pulse voltages having opposite polarities are supplied to the Y electrodes 112 and the address electrodes 122. Due to the discharges, charged particles stick to lateral surfaces of the barrier ribs 130 within the discharge cells 126, and thus wall charges are accumulated on the lateral surfaces.

After such an address discharge, a higher pulse potential is supplied to the Y 8 electrodes 112, and a lower pulse potential is supplied to the X electrodes 113. The wall charges accumulated during the address discharge are moved due to a potential difference between the X and Y electrodes 113 and 112. The moving wall charges collide with the atoms of the discharge gas within the discharge cells 126, so that a discharge is generated to thereby produce a plasma.

UV light is generated during the discharge and excites the phosphor layers 125 arranged within the discharge cells 126. While the energy levels of the excited phosphor layers 125 are changed to lower levels, visible light is produced. Thus, an image is displayed on the PDP.

When the potential difference between discharge electrode pairs 114 becomes lower than a discharge voltage after the generation of a discharge, no more discharge is generated, and space charges and wall charges are formed in the discharge cells 126. When different pulse voltages are alternately supplied between discharge electrode pairs 114, the potential difference reaches a firing voltage by the help of the wall charges, and a discharge is re-generated.

When the alternate application of different pulse potentials between the discharge electrode pairs 114 is repeated, a discharge is sustained. This discharge is referred to as a sustain discharge. Due to the sustain discharge, the gray scale of the PDP 100 is determined, and an image is displayed according to the determined gray scale.

As the distance between the Y electrodes 112 and the address electrodes 122 increases or the sizes of portions of the address electrodes that face the Y electrodes decrease during an address discharge, a higher driving voltage is required. Hence, the luminous efficiency is reduced, and the address discharge is delayed. When a driving voltage for an address discharge increases, a stable driving of the PDP 100 is hindered. This necessitates an increase in the price of an integrated circuit chip that controls an electrical signal supplied to the Y electrodes 112 and the address electrodes 122. As a result, the manufacturing costs of the PDP 100 are increased, and the price competitiveness thereof is lowered.

However, since the PDP 100 according to the embodiment illustrated in FIGS. 2 and 3 includes the floating electrodes 119 which are closer to the Y electrodes 112 than to the X electrodes 113, the above-described problems can be addressed. In particular, since the floating electrodes 119 are disposed between the Y electrodes 112 and the address electrodes 122, and the portions 1221 of the address electrodes 122 of the address electrodes that face the Y electrodes 112 are wider than the portions 1222 that face the X electrodes 113, the above-described problems can be more easily solved.

When an electrical signal is not directly supplied to the floating electrodes 119 and a potential is supplied to the Y electrodes 112, a potential similar to the potential supplied to the Y electrodes 112 is induced in the floating electrodes 119. Hence, a predetermined potential difference is formed between the floating electrodes 119 and the address electrodes 122. This potential difference causes an initial discharge to be generated within the discharge cells 126.

The initial discharge generated between the floating electrodes 119 and the address electrodes 122 causes a discharge to be generated between the Y electrodes 112 and the wide portions 1221 of the address electrodes 122 that face the Y electrodes. Hence, the amount of discharge is increased.

Therefore, the floating electrodes 119 and the address electrodes 122 including the wide portions 1221 that face the Y electrodes 112 help the amount of discharge between the Y electrodes 112 and the address electrodes 122 to be increased and reduce the need for a driving voltage for driving the Y electrodes 112 and the address electrodes 122 to be increased.

In other words, the amount of discharge can be increased without increasing the cost of integrated circuit chips as described above. With an increase in the amount of discharge, the amount of UV light generated increases. Consequently, the brightness of the PDP 100 is improved.

Figure 4:
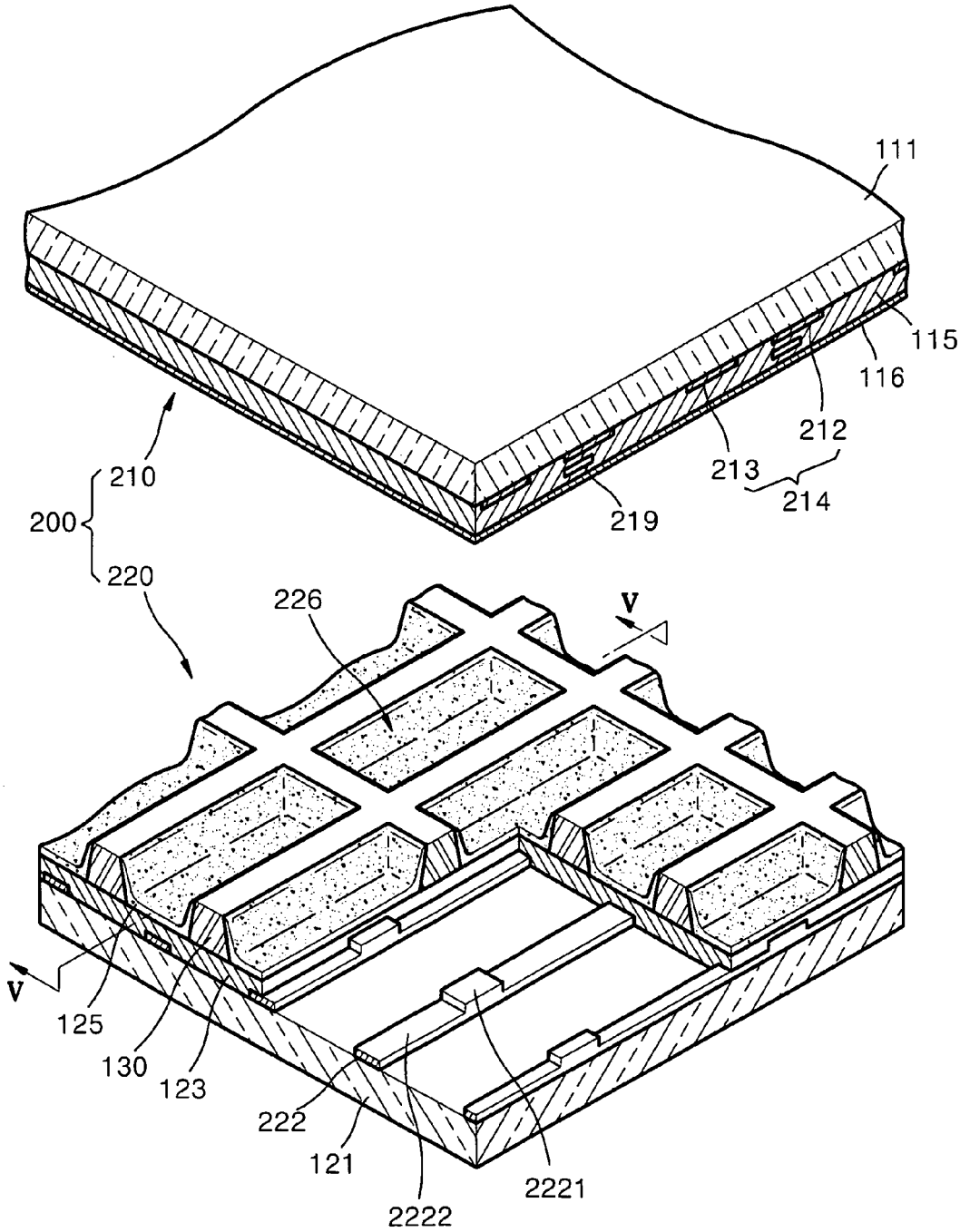
FIG. 4 is an exploded perspective view of a PDP according to another embodiment of the present invention.
Figure 5:
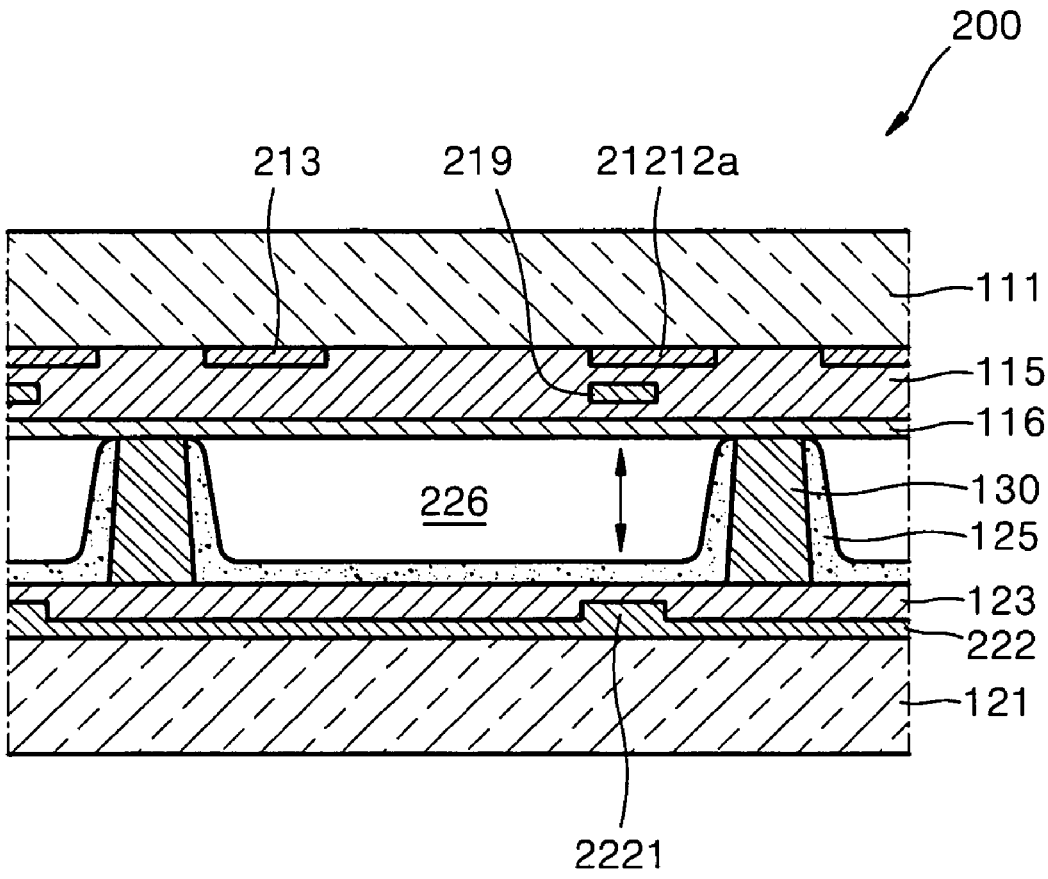
FIG. 5 is a cross-section taken along line V-V of FIG. 4.

FIG. 4 is an exploded perspective view of a PDP 200 according to another embodiment of the present invention. FIG. 5 is a cross-section taken along line V-V of FIG. 4.

The PDP 200 is described below in greater detail by focusing on features different from the PDP 100.

The PDP 200 is different from the PDP 100 in that the X electrodes 213 and the Y electrodes 212 are formed of only a metallic conductor, no transparent electrodes are included, and address electrodes 222 are shaped so that the distances between the Y electrodes 212 and portions 2221 facing the Y electrodes are shorter than distances between the X electrodes 213 and portions 2222 facing the X electrodes. More specifically, the portions 2221 of the address electrodes 222 protrude.

In the PDP 100, the X electrodes 113 and the Y electrodes 112 are arranged on the path of visible light as described above. Hence, in order not to block the visible light generated within the discharge cells 126, the metal bus electrodes 113*a* and 112*a* are arranged over the barrier ribs 130, and the transparent electrodes 113*b* and 112*b* are arranged on the path of the visible light so as to transmit the visible light.

However, transparent electrodes 113*b* and 112*b*, which are formed of ITO, etc., are costlier than the metal bus electrodes 113*a* and 112*a*, and shaping the transparent electrodes is difficult. This increases the manufacturing costs of the PDP 100. However, when the transparent electrodes are not used, an interval between electrodes is greatly increased, and accordingly, the driving voltage is increased. This leads to an increase in the cost of integrated circuit chips, etc., so that the manufacturing costs of the PDP 100 are increased.

On the other hand, in the PDP 200, floating electrodes 219 are arranged between the Y electrodes 212 and the address electrodes 222, and intervals between the Y electrodes 212 and the address electrodes 22 are short. Hence, the driving voltage is not increased, and thus at least a part of transparent electrodes need not be used.

Figure 6:
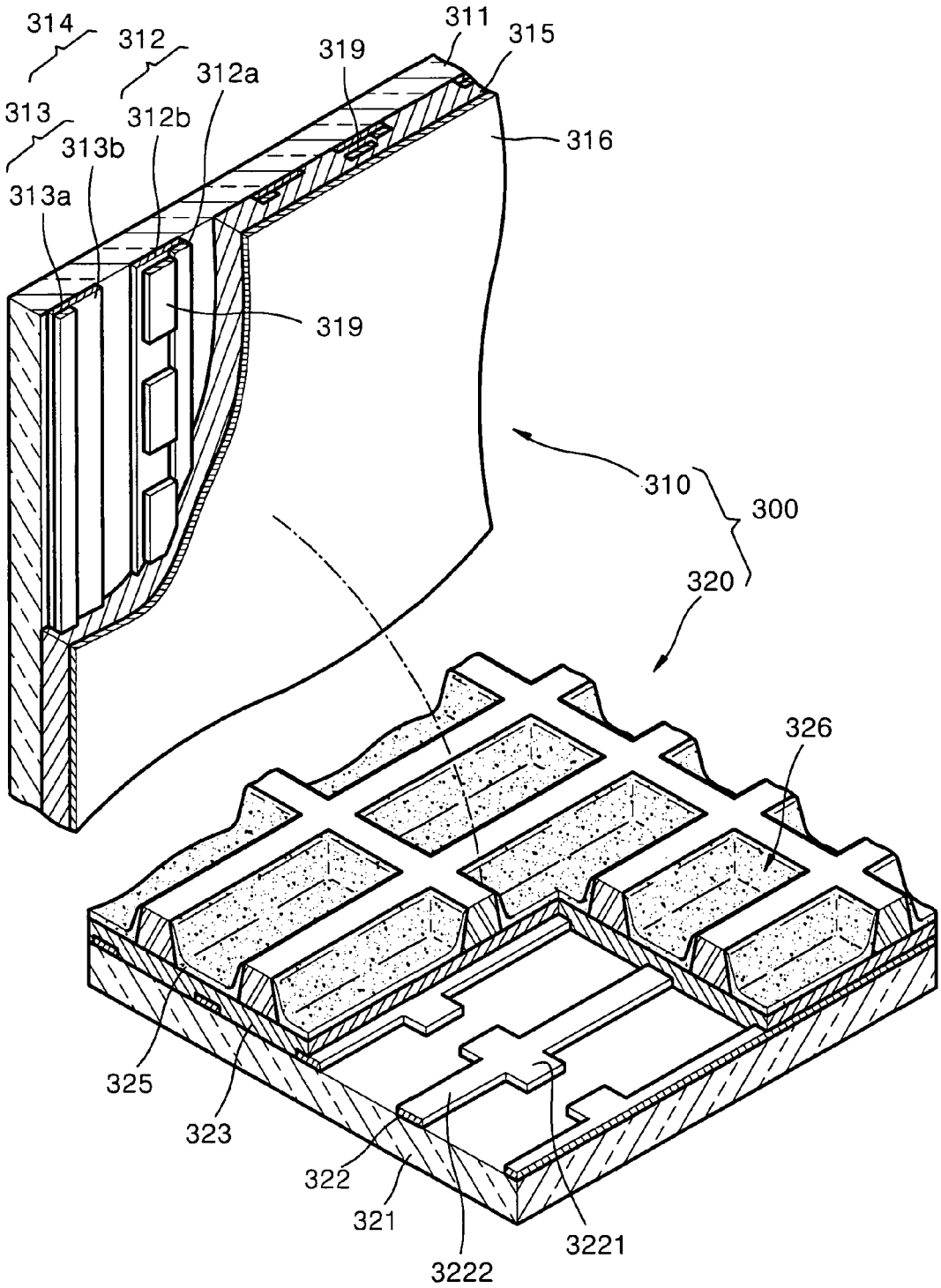
FIG. 6 an exploded perspective view of a PDP according to another embodiment of the present invention.

FIG. 6 an exploded perspective view of a PDP 300 according to another embodiment of the present invention.

The PDP 300 is described below in greater detail by focusing on features different from the PDP 100.

Since floating electrodes 319 are not electrically connected to the outside, they do not need to extend in one direction like discharge electrode pairs 314. Hence, as illustrated in FIG. 6, the floating electrodes 319 can be shaped so that electrically separate electrodes are allocated to discharge cells 326 one by one.

When the floating electrodes 319 are electrically separated and arranged to correspond to the discharge cells 326 one to one as described above, the floating electrodes are isolated from one another within the discharge cells 326 even though charges are induced by electrodes 313 and 312 adjacent to the floating electrodes. Hence, discharge cells 326 do not affect one another, and thus, a possible erroneous discharge can be prevented.

A PDP according to the present invention having a structure as described above has the following advantages. First, the brightness of the PDP is improved by reducing intervals between address electrodes and Y electrodes of the PDP or increasing the sizes of portions of the address electrodes that face the Y electrodes.

Second, the cost of devices, such as, integrated circuit chips for driving the PDP, are reduced by lowering a firing voltage between the address electrodes and the Y electrodes, thereby reducing the manufacturing costs of the PDP.

Third, a delay of an address discharge between the address electrodes and the Y electrodes can be reduced.

While the present invention has been particularly shown and described with reference to exemplary embodiments thereof, it will be understood by those of ordinary skill in the art that various modifications in form and detail can be made therein without departing from the spirit and scope of the present invention as defined by the following claims.

What is claimed is:

1. A Plasma Display Panel (PDP), comprising:

a first substrate;

a second substrate spaced apart from the first substrate and facing the first substrate;

barrier ribs arranged between the first and second substrates and defining discharge cells where a discharge occurs;

a plurality of discharge electrode pairs comprising X electrodes and Y electrodes extending across the discharge cells;

a plurality of floating electrodes each arranged adjacent to a respective Y electrode, and each arranged corresponding to the Y electrode and a respective X electrode;

address electrodes extending across the discharge cells and intersecting the discharge electrode pairs within the discharge cells, portions of the address electrodes facing the Y electrodes being wider than portions of the address electrodes facing the X electrodes; and phosphor layers arranged within the discharge cells, wherein each of the plurality of floating electrodes is arranged below the respective Y electrode and between the respective Y electrode and the second substrate, and each of the plurality of floating electrodes is arranged closer to the respective Y electrode than to the respective X electrode.

2. The PDP of claim 1, wherein the discharge electrode pairs comprise metallic conductors.

3. The PDP of claim 2, wherein the discharge electrode pairs comprise transparent electrodes, and bus electrodes of a metallic conductor.

4. The PDP of claim 1, wherein the floating electrodes comprise metallic conductors.

5. The PDP of claim 1, wherein the floating electrodes comprise transparent electrodes.

6. The PDP of claim 1, wherein each of the floating electrodes are electrically separated to prevent electrical signals from being received by the floating electrodes.

7. The PDP of claim 1, wherein a voltage is induced in each of the floating electrodes in response to a voltage being supplied to the Y electrodes.

8. The PDP of claim 1, wherein the floating electrodes are electrically separated and arranged to correspond to the discharge cells one to one.

9. The PDP of claim 1, wherein the floating electrodes are arranged between the Y electrodes and the address electrodes.

10. The PDP of claim 1, wherein the X electrodes and the Y electrodes extend parallel to one another.

11. The PDP of claim 1, further comprising:

a first dielectric layer covering the discharge electrode pairs and the floating electrodes; and a second dielectric layer covering the address electrodes.

12. The PDP of claim 11, wherein:

the discharge electrode pairs are arranged on the first substrate opposite to the second substrate and covered by the first dielectric layer;

the address electrode pairs are arranged on the second substrate opposite to the first substrate and covered by the second dielectric layer; and the barrier ribs are arranged between the first and second dielectric layers.

13. The PDP of claim 11, further comprising a protection film arranged to cover at least a portion of the first dielectric layer.

14. The PDP of claim 1, further comprising a discharge gas contained within the discharge cells.

15. The PDP of claim 14, wherein the discharge gas comprises Xe of no less than 10% volume.

16. A Plasma Display Panel (PDP), comprising:

a first substrate;

a second substrate spaced apart from the first substrate and facing the first substrate;

barrier ribs arranged between the first and second substrates and defining discharge cells where a discharge occurs;

a plurality of discharge electrode pairs comprising X electrodes and Y electrodes extending across the discharge cells;

a plurality of floating electrodes each arranged adjacent to a respective a Y electrode, and each arranged corresponding to the Y electrode and a respective X electrode;

address electrodes extending across the discharge cells and intersecting the plurality of discharge electrode pairs within the discharge cells, distances between the Y electrodes and portions of the address electrodes facing the Y electrodes being shorter than distances between the X electrodes and portions of the address electrodes facing the X electrodes; and phosphor layers arranged within the discharge cells, wherein each of the plurality of floating electrodes is arranged below the respective Y electrode and between the respective Y electrode and the second substrate, and each of the plurality of floating electrodes is arranged closer to the respective Y electrode than to the respective X electrode.

17. The PDP of claim 16, wherein each of the floating electrodes are electrically separated to prevent electrical signals from being received by the floating electrodes.

18. The PDP of claim 16, wherein the portions of the address electrodes facing the Y electrodes protrude from the address electrodes.

19. The PDP of claim 16, further comprising:

a first dielectric layer covering the discharge electrode pairs and the floating electrodes; and a second dielectric layer covering the address electrodes.

20. The PDP of claim 16, further comprising a discharge gas contained within the discharge cells, the discharge gas including Xe of no less than 10% volume.

* * * * *